US011046902B2

(12) United States Patent
Gonzalez et al.

(10) Patent No.: US 11,046,902 B2
(45) Date of Patent: Jun. 29, 2021

(54) TRANSPORTABLE BITUMEN BLENDS HAVING A SEPERABLE HIGH-OCTANE LOW VAPOR PRESSURE FRACTION

(71) Applicant: Cenovus Energy Inc., Calgary (CA)

(72) Inventors: Manuel F. Gonzalez, Calgary (CA); Timothy Michael Koskowich, Calgary (CA); Eusebio Palmisano, Calgary (CA)

(73) Assignee: Cenovus Energy Inc., Calgary (CA)

( * ) Notice: Subject to any disclaimer, the term of this patent is extended or adjusted under 35 U.S.C. 154(b) by 130 days.

(21) Appl. No.: 15/950,981

(22) Filed: Apr. 11, 2018

(65) Prior Publication Data

US 2018/0291293 A1 Oct. 11, 2018

Related U.S. Application Data

(60) Provisional application No. 62/484,317, filed on Apr. 11, 2017.

(51) Int. Cl.
*C10L 1/16* (2006.01)
*C10G 7/02* (2006.01)

(52) U.S. Cl.
CPC ..... *C10L 1/1616* (2013.01); *C10G 7/02* (2013.01); *C10G 2300/104* (2013.01); *C10G 2300/1044* (2013.01); *C10G 2300/207* (2013.01); *C10G 2300/302* (2013.01); *C10G 2300/305* (2013.01); *C10G 2300/308* (2013.01); *C10G 2400/02* (2013.01); *C10G 2400/16* (2013.01)

(58) Field of Classification Search
CPC ..... C10G 7/02; C10G 2300/104; C10G 2300/1044; C10G 2300/207; C10G 2300/302; C10G 2300/305; C10G 2300/308; C10G 2400/02; C10G 2400/16; C10L 1/1616
See application file for complete search history.

(56) References Cited

U.S. PATENT DOCUMENTS 2,276,199 A 3/1942 Kassel
2,425,340 A 8/1947 Nixon et al.
4,383,914 A * 5/1983 Kizior ..... C10G 31/10 208/177

(Continued)

OTHER PUBLICATIONS

"New equations help rapidly determine alkylate octane numbers", Lyle F. Albright, et al., Oil and Gas Journal; Jan. 18, 1999;97,3, ProQuest pp. 51-54 (4 pages).

(Continued)

*Primary Examiner* — Latosha Hines
(74) *Attorney, Agent, or Firm* — Osha Bergman Watanabe & Burton LLP

(57) ABSTRACT

Low vapor pressure hydrocarbon blends are provided, comprising miscible and separable hydrocarbon fractions. A high-octane low-boiling point diluent fraction may be combined with a high-boiling point bitumen fraction. In select embodiments, and the blend may have a viscosity of less than about 350 cSt and a density of less than about 940 kg/m$^3$ over a temperature range of from 7.5° C. to 18.5° C. After transportation, for example by pipeline, the high-octane low-boiling point diluent fraction may be recovered from the blend, and may for example be used as a high-octane gasoline blendstock.

8 Claims, 8 Drawing Sheets

(56) References Cited

U.S. PATENT DOCUMENTS

| | | | | |
|---|---|---|---|---|
| 6,274,783 | B1 | 8/2001 | Gildert et al. | |
| 6,897,345 | B2 | 5/2005 | Marchionna et al. | |
| 8,002,968 | B2 * | 8/2011 | Flint | C10G 45/00 208/93 |
| 2013/0067991 | A1 * | 3/2013 | Schabron | G01N 30/461 73/23.37 |
| 2014/0138287 | A1 * | 5/2014 | De Klerk | C10G 55/04 208/390 |
| 2018/0298289 | A1 * | 10/2018 | Huq | C10G 21/003 |

OTHER PUBLICATIONS

"Conversion of Isobutylene to Octane-Booster Compounds After Methyl Tert-Butyl Ether Phaseout: The Role of Heterogeneous Catalysis", Hilman Ibnu Mandi and Oki Muraza, I&EC Research, ACS Publications, American Chemical Society, pp. 11193-11210 (18 pages).

"Production of Isooctane from Isobutene: Energy Integration and Carbon Dioxide Abatement via Catalytic Distillation", Behnam M. Goortani et al., ACS Publications, American Chemical Society, pp. 3570-3581 (12 pages).

"The Oil Compatibility Model and Crude Oil Incompatibility", Irwin A. Wiehe et al., Energy and Fuels 2000, 14,American Chemical Society, pp. 56-59 (4 pages).

* cited by examiner

Figure 1 Iso-Octane based diluent, Kinematic Viscosity vs. Temperature
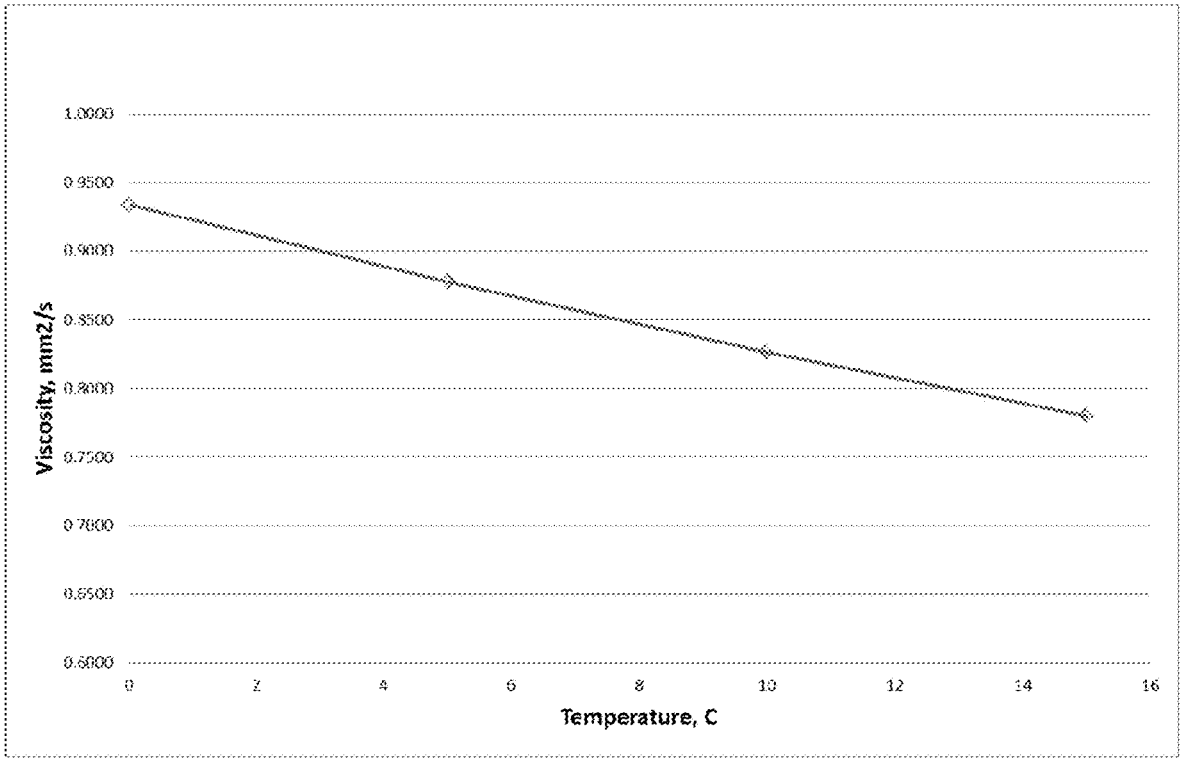

Figure 2 Iso-Octane based diluent (70.4° API at 15°C), Density vs. Temperature
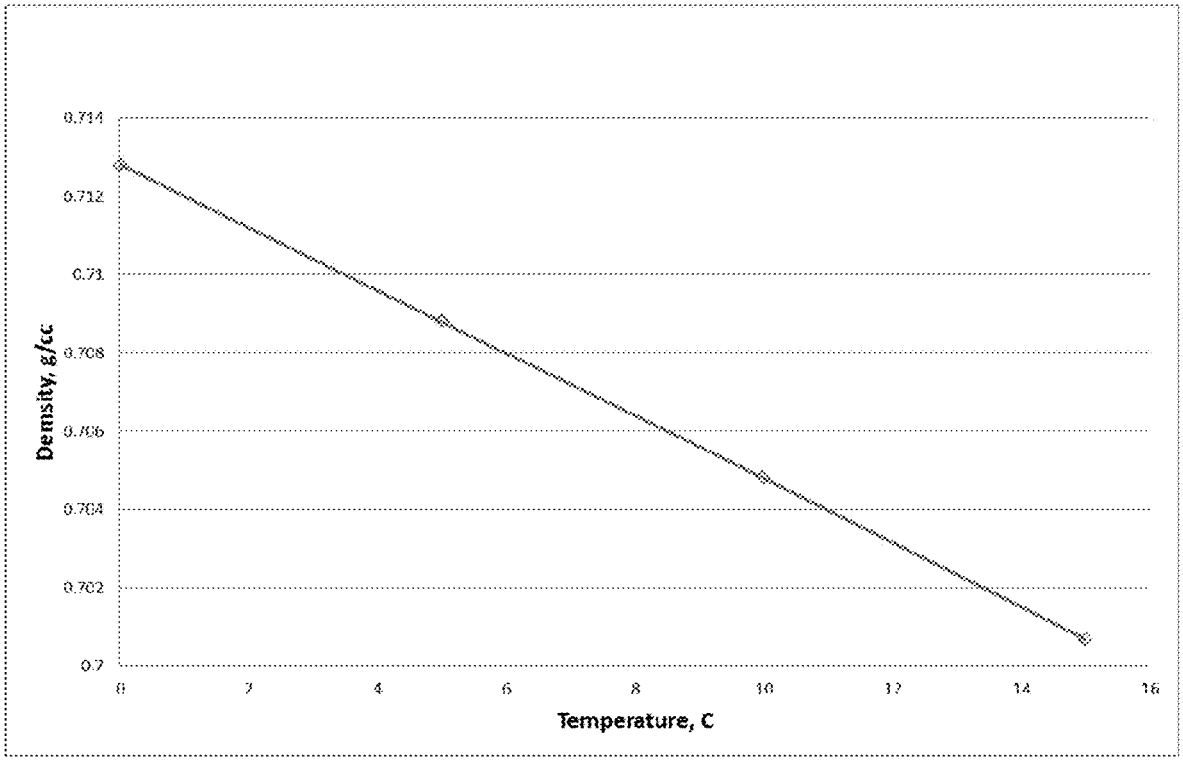

Figure 3 Raw Athabasca Bitumen Kinematic Viscosity vs. Temperature
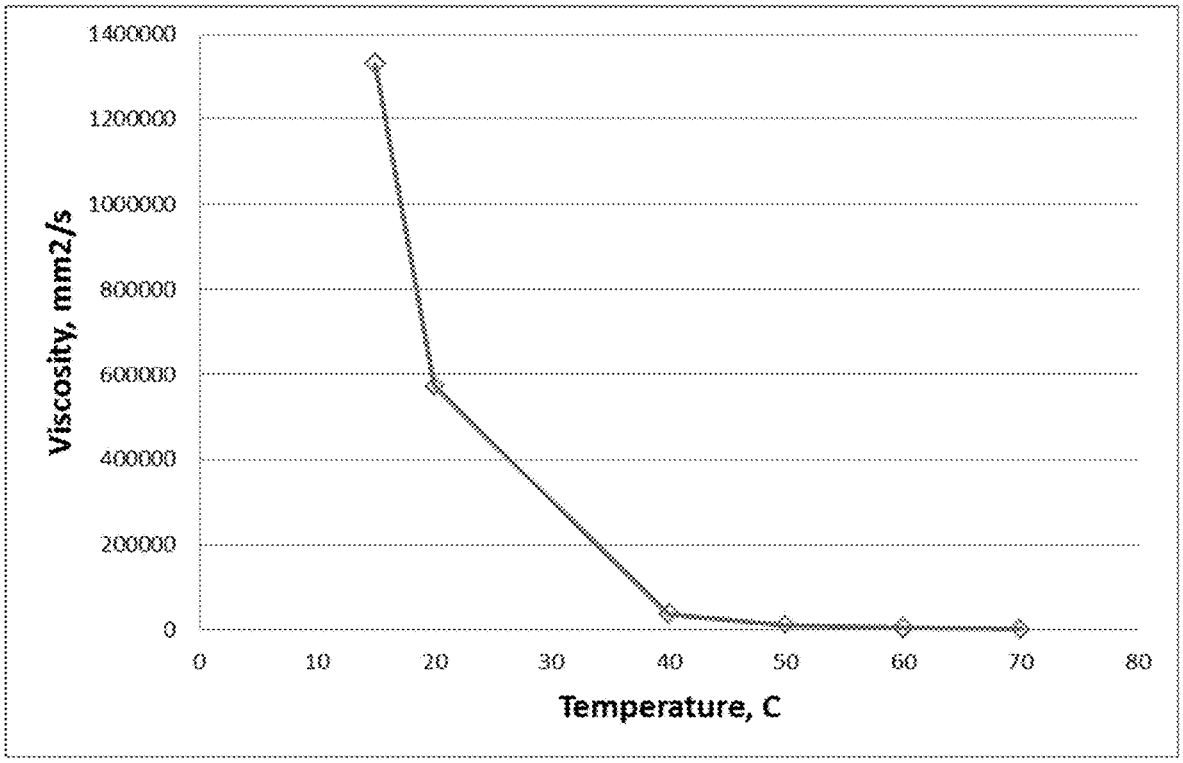

Figure 4 Raw Athabasca Bitumen (8.2° API) Density vs. Temperature
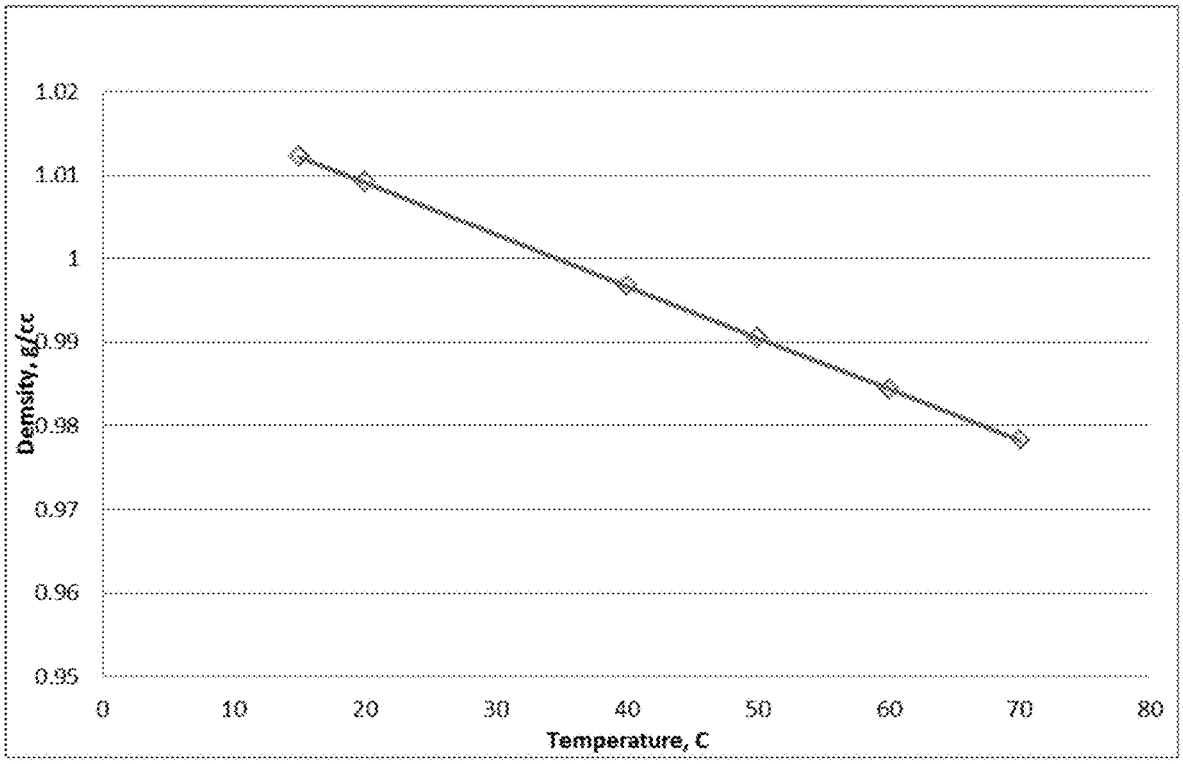

Figure 5 Iso-Octane Based Diluent / Bitumen Blend Kinematic Viscosity vs. Diluent %Vol
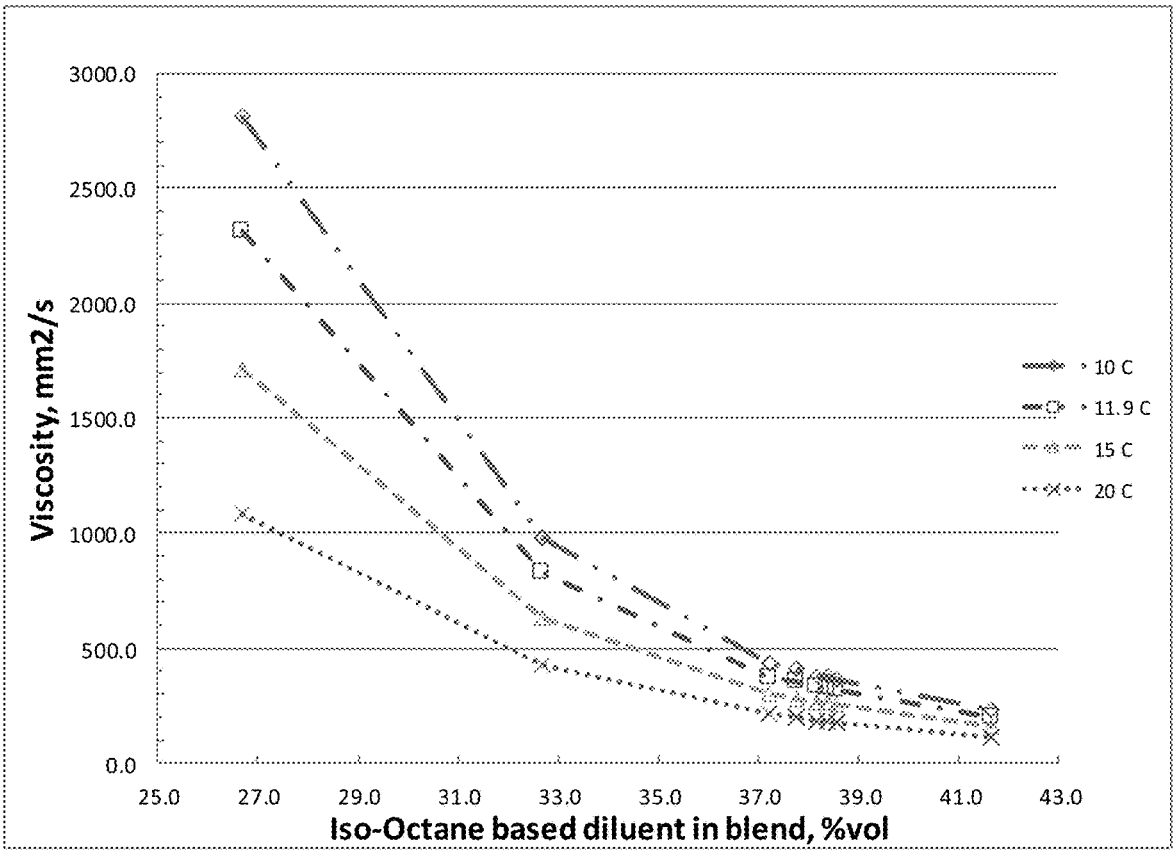

Figure 6 Iso-Octane Based Diluent / Bitumen Blend Simulated Distillation (ASTM D7169-05)
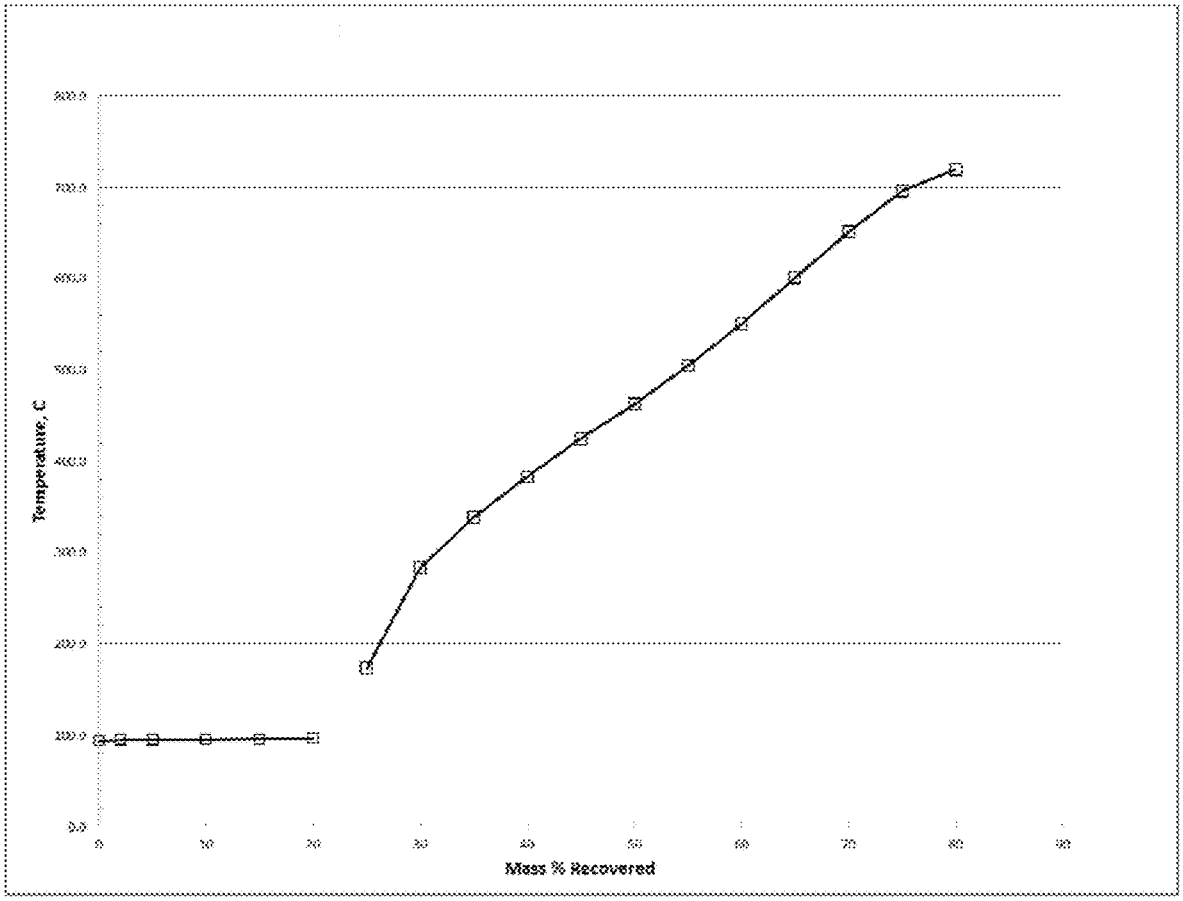

Figure 7 Iso-Octane Based Diluent / Bitumen Blend Fractionation
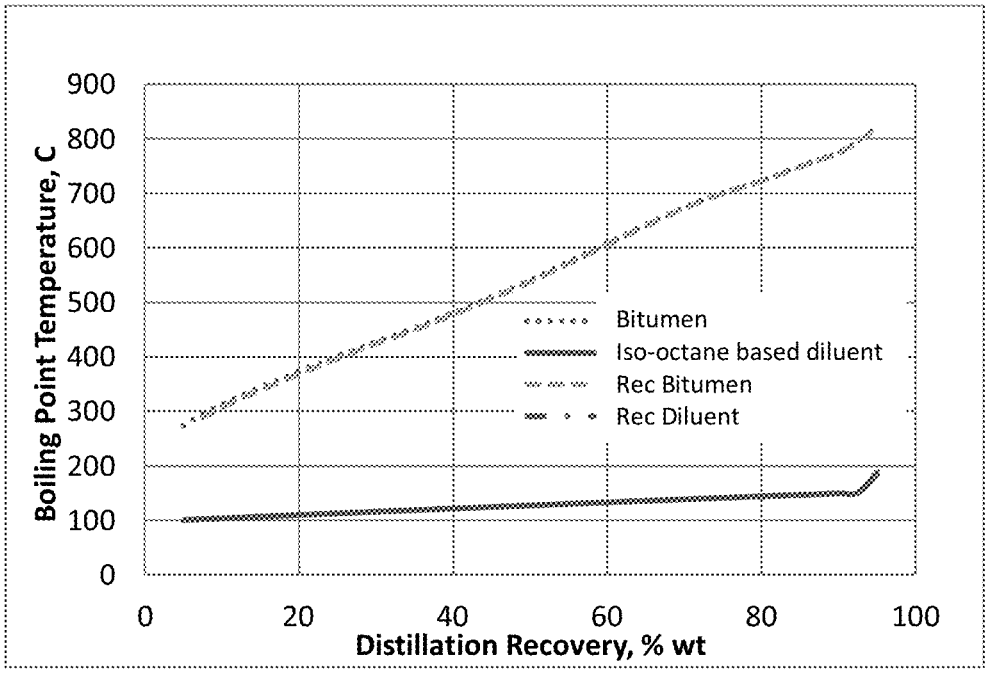

Figure 8 Iso-Octane Based Diluent / Bitumen Blend Compatibility Study
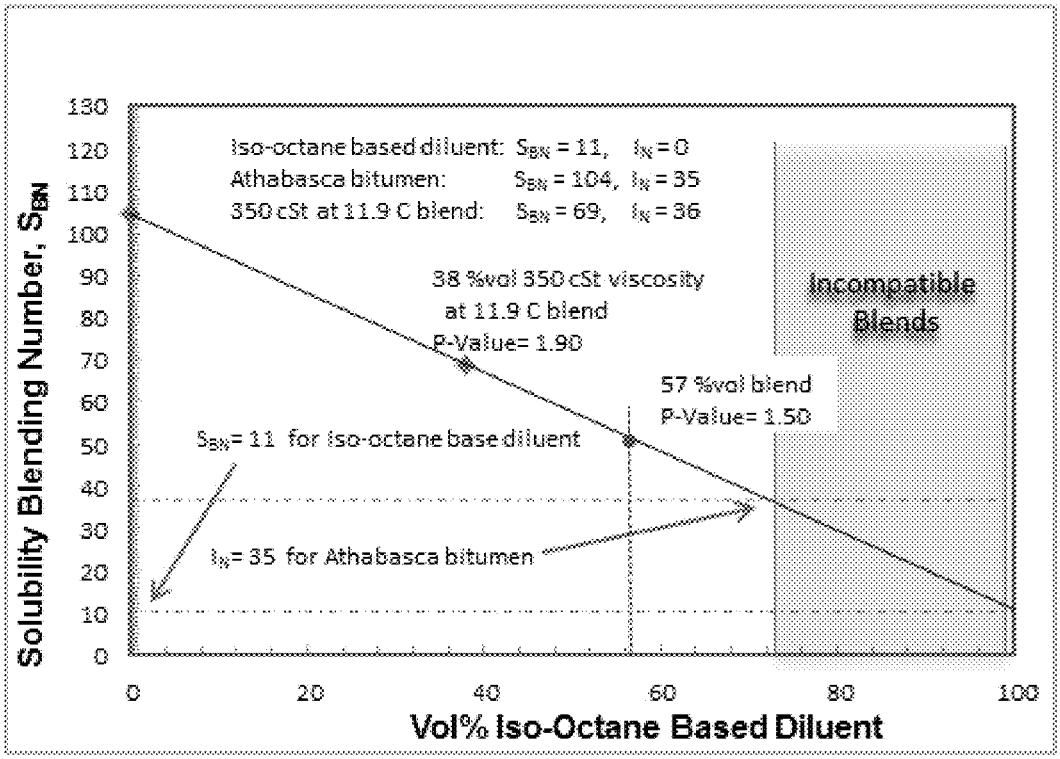

TRANSPORTABLE BITUMEN BLENDS HAVING A SEPERABLE HIGH-OCTANE LOW VAPOR PRESSURE FRACTION

FIELD OF THE INVENTION

The invention is in the field of hydrocarbon blending, transportation and refining, including the production by mixing and separation of liquid hydrocarbons comprising bituminous materials and lighter hydrocarbons.

BACKGROUND OF THE INVENTION

Higher-mileage gasoline-powered vehicles typically burn high-octane fuels in efficient small engines. The octane rating of a gasoline is measured by comparison with a reference fuel that is a mixture of 2,2,4-trimethylpentane (iso-octane) and heptane. The percentage, by volume, of iso-octane in that mixture is the octane number of the fuel, reflecting the tendency of the gasoline to resist self-ignition. Generally, gasoline is a mixture of many hydrocarbons, principally paraffins (alkanes), cycloalkanes (naphthenes), and olefins (alkenes), as well as other additives. High-octane gasoline may be produced by adding a variety of high-octane gasoline blendstocks, including iso-octane, to the fuel. Aspects of the present invention relate to high-octane gasoline blendstocks.

Gasoline blendstocks may be prepared synthetically. Conventional industrial processes for iso-octane production, for example, involve the steps of dimerization of isobutane, dimer separation and hydrogenation, with a wide variety of alternative approaches available (see U.S. Pat. Nos. 2,276,199; 2,425,340; 6,274,783: Goortani et al., Industrial & Engineering Chemistry Research, 2015, 54 (14), 3570-3581; and Mahdi et al, Industrial & Engineering Chemistry Research, 2016 55 (43), 11193-11210). In this context, as is common in oil refining terminology, alkylation refers to particular alkylation reactions, typically involving reacting iso-butane with olefins (see U.S. Pat. No. 6,897,345). Commercially, alkylation units may be used to provide a variety of synthetic alkylates, typically having a high content of branched paraffinic C7-C8 hydrocarbons such as iso-octane, for use as premium blendstocks for gasoline.

The octane rating of a gasoline blend may be calculated in a variety of ways. One system of octane rating is the Research Octane Number (RON), determined by running the fuel in a test engine under controlled conditions, and comparing the results with those for mixtures of iso-octane and n-heptane. Another method for octane rating is called the Motor Octane Number (MON), determined under different testing conditions than RON testing. In some circumstances, octane ratings are given as the average of the RON and the MON (often identified as (R+M)/2). In the context of the present disclosure, where no specific testing method is given, the relative octane ratings of fuels or blendstocks means the relative octane ratings as tested by any accepted method of octane determination. In general, the octane ratings for regular-grade fuel range from 85 to 87, midgrade fuels are rated 88 to 90, and premium fuel has an octane rating of 91 and higher. As a blendstock, typically alkylates have octane ratings above 90, for example from 94 to 97 (for methods of predicting the octane number of alkylates, see Albright and Eckert, 1999, Oil & Gas Journal 97(3), 51-54).

Aspects of the present disclosure relate to the transportation, blending and refining of hydrocarbons. These are fields rich with specialized descriptive jargon, which is used in the present context in keeping with the generally recognized meanings in the art Accordingly, "petroleum" is a naturally occurring mixture consisting predominantly of hydrocarbons in the gaseous, liquid or solid phase, which includes various oxygen, nitrogen and sulfur containing compounds, and typically trace amounts of metal-containing compounds. In the context of the present disclosure, the words "petroleum", "oil" and "hydrocarbon" are generally used interchangeably to refer to mixtures of widely varying composition, as will be evident from the context in which the word is used. "Fluids", such as petroleum fluids, include both liquids and gases.

It is common practice to segregate petroleum substances of high viscosity and density into two categories, "heavy oil" and "bitumen". For example, some sources define "heavy oil" as a petroleum that has a mass density of greater than about 900 kg/m$^3$ (or an API gravity of about 26°). Bitumen is sometimes described as that portion of petroleum that exists in the semi-solid or solid phase in natural deposits, with a mass density greater than about 1,000 kg/m$^3$ (or an API gravity of about 10°) and a viscosity greater than 10,000 centipoise (cP or 10 Pa·s) measured at original temperature in the deposit and atmospheric pressure, on a gas-free basis. Although these terms are in common use, references to heavy oil and bitumen represent categories of convenience, and there is a continuum of properties between heavy oil and bitumen. Accordingly, references to heavy oil and/or bitumen herein include the continuum of such substances, and do not imply the existence of some fixed and universally recognized boundary between the two substances. In particular, the term "heavy oil" includes within its scope all "bitumen" including hydrocarbons that are present in semi-solid or solid form.

The transportation of heavy oils, particularly by pipeline, may be problematic because of the high viscosity of these fluids. One approach to solving this problem is to mix the heavy oil with a less viscous miscible fluid, which may be referred to as a diluent. Bitumen mixed with a diluent may accordingly be referred to as dilbit. Bitumen may be upgraded to produce a lighter fluid known as synthetic crude oil, typically with an API gravity of 31° to 33°, and synthetic crude may in turn be mixed with bitumen to reduce the viscosity of the bitumen for transport, in the form of what is often called synbit. In the context of the present disclosure relating to bitumen blends, the term "diluent" refers to any fluid mixed with bitumen.

The amount of diluent required depends upon the specific transportation specifications to be met, the characteristics of the extracted hydrocarbons to be transported and the characteristics of the diluent. For example, a smaller amount of a diluent having a higher API gravity would need to be added to the extracted hydrocarbons in comparison to a diluent having a lower API gravity. Hydrocarbons such as Canadian bitumen may have an API gravity of, for example, 8°-10°, and may require mixing with 20% to 50% diluent in order to meet the transportation specifications for transport. Regardless of the particular diluent used, the diluent either needs to be produced on site, which may require expensive processing equipment, or must be produced elsewhere and transported to site. There is a significant cost associated with using diluent to meet oil transportation specifications, For example, in order to be transported by pipeline, the diluted hydrocarbons must typically have a basic sediment and water (BS&W) concentration of less than 0.5% by volume (vol % or % vol), a viscosity of 350 cSt or less, and an API gravity of 19° or greater, which may be specified as a maximum density specification of 940 kg/m$^3$. Transportation specifications may change seasonally or over time.

Bitumen extracted from oil sands in Alberta may contain approximately 15% to 20% by weight (wt % or % wt) asphaltenes and may be processed to remove water and sediment to meet the BS&W requirements; however, such treated bitumen may still have a much lower API gravity of, for example, 17° and a higher viscosity of 8,250 cSt compared to the required transportation specifications. The diluent used may have varying characteristics; however, the diluent should generally have a higher API gravity and a lower viscosity than the transportation specifications in order to meet the transportation specifications when mixed with the hydrocarbons. As an example, the diluent may comprise natural gas condensate with an API gravity of approximately 75° and a viscosity of 0.45 cSt. It will be appreciated that the amount of diluent required to be mixed will depend upon the characteristics of the diluent used. However, generally between 20% vol and 50% vol is used in order to dilute the extracted hydrocarbons in order to meet transportation specifications. Further, it will be appreciated that the measurements of the characteristics are given for a reference temperature, which may differ from the actual temperature of the hydrocarbons. Further, the transportation specifications may change throughout the year.

Accordingly, the fluids typically used to produce dilbit presently include natural gas condensates or lighter crudes (including synthetic crudes). Commonly, one barrel of condensate is mixed with every three barrels of bitumen to produce dilbit for pipeline transport. The addition of these diluents to heavy oils adds to transportation costs and complicates the processing of the dilbit into commercial products such as gasoline. For example, condensate is rich in light naphtha (20° C.-70° C. fraction), and dilbit accordingly often has a light naphtha fraction on the order of 15% and an attendant Reid vapor pressure (RVP) on the order of 103 kPa at 37.8° C. RVP is a common measure of the volatility of petroleum liquids, defined as the absolute vapor pressure exerted by a liquid at 37.8° C. (100° F.) as determined by the test method ASTMD5191. This light naphtha fraction may confer an undesirably high vapor pressure on the dilbit, giving rise to safety and environmental concerns, while from an economic perspective the dilbit naphtha fraction suffers from relatively poor gasoline blending qualities (for example low octane numbers).

SUMMARY OF THE INVENTION

Low vapor pressure hydrocarbon blends are provided, comprising miscible and thermally separable hydrocarbon fractions. A high-octane low-boiling point diluent fraction may be combined with a nigh-boiling point bitumen fraction. The isolated bitumen may for example be characterized as having a viscosity of at least 700,000 cSt at 15° C., and/or a density of less than or equal to 1,000 kg/m$^3$ (API gravity of 10°) at 15° C. The volume fraction of bitumen in the blend may for example be higher than 60%, or between 65% and 75%. The volume fraction of diluent in the blend may correspondingly, for example, be lower than 40%, or between 25% and 35%. The bitumen and diluent fractions have distinct distillation characteristics, which may be used to characterize the fractions even if they are in practice separated by methods that do not involve distillation. For example, the temperature at which 5% of the bitumen fraction has distilled (8P-bitumen$_{5\ vol\ \%}$, BP =boiling point) may be higher than the temperature at which 95% of the diluent fraction has distilled (BP-diluent$_{95\ vol\ \%}$). The BP-bitumen$_{5\ vol\ \%}$ may for example be greater than or equal to 220° C., and the BP-diluent$_{95\ vol\ \%}$ may correspondingly be less than or equal to 220° C. Alternatively, the initial boiling point (IBP) of the bitumen fraction may be higher than the final boiling point (FBP) of the diluent fraction. In select embodiments, the blend may have a viscosity of less than about 350 cSt and a density of less than about 940 kg/m$^3$ over a temperature range of from 7.5° C. to 18.5° C. The blend may also alternatively have a Reid vapor pressure (RVP) of less than about 65 KPa, or 60 kPa, or 50 kPa.

In select embodiments, the isolated diluent fraction may for example have an (R+M)/2 octane rating higher than that of a diluent (e.g., an oil sands condensate; a natural-gas condensate; a synthetic hydrocarbon blend; naphtha) currently utilized for treating bitumen or heavy oil to meet pipeline transportation specifications. The isolated diluent fraction may for example have an (R+M)/2 octane rating of at least 60 or at least 66. In other embodiments, the isolated diluent fraction may for example have an (R+M)/2 octane rating of at least 80, or of higher than 88. The diluent fraction may for example include at least 25% iso-octane or isohexane by volume, or greater than 85% or 95% by volume branched-chain alkanes. The blend may for example include less than 1% by weight olefins, as for example determined by proton nuclear magnetic resonance ($^1$H-NMR) spectroscopy. Alternatively, if the blend includes more than or equal to 1% by weight olefins, the blend may be transported by buffering the blend in the pipeline, for example, with a hydrocarbon product such as natural gas condensate or crude oil having less than 1% by weight olefins.

In alternative aspects, methods are provided for transporting hydrocarbons, in the form of the hydrocarbon blends of the invention, for example involving transporting the blend by pipeline: and then thermally separating, for example by distillation, the diluent fraction from the bitumen fraction. For example, at least 95% or 98% of the diluent may be separated from the bitumen in the step of thermal separation. The diluent separated from the bitumen may for example be used as a high-octane gasoline blendstock, for example having an (R+M)/2 octane rating of at least 80 or higher than 88.

BRIEF DESCRIPTION OF THE DRAWINGS

FIG. 1 is a line graph illustrating the kinematic viscosity (mm$^2$/s) of an iso-octane based diluent over a range of temperatures.

FIG. 2 is a line graph illustrating the density (g/cc) of an iso-octane based diluent over a range of temperatures.

FIG. 3 is a line graph illustrating the kinematic viscosity (mm$^2$/s) of a sample of bitumen from the Athabasca oil sands in Northern Alberta, Canada over a range of temperatures.

FIG. 4 is a line graph illustrating the density (g/cc) of a sample of bitumen from the Athabasca oil sands over a range of temperatures.

FIG. 5 is a line graph illustrating the kinematic viscosity (mm$^2$/s) of an iso-octane based diluent bitumen blend at different concentrations of iso-octane and at different temperatures.

FIG. 6 is a line graph illustrating the distillation curve (temperature vs. mass % recovered) of an iso-octane based diluent/bitumen blend. This curve is obtained by a Simulated Distillation Analysis (ASTM D7169-05, Standard Test Method for Boiling Point Distribution of Samples with Residues Such as Crude Oils and Atmospheric and Vacuum Residues by High Temperature Gas Chromatography, American Society for testing and Materials International (ASTM), West Conshohocken, Pa., 2005) and shows the discontinuity represented by the gap between the two distillation curves. This "5-95" gap, used to quantify the degree of overlap in volatility between adjacent hydrocarbon fractions, is the difference, in degrees C., between the 5% ASTM temperature of a heavy fraction, (i.e. the temperature at which 5% of the heavy fraction has distilled), minus the 95% ASTM temperature of the lighter fraction, (i.e. the temperature at which 95% of the lighter fraction has distilled). This discontinuity is what facilitates the separation (fractionation) of the diluent and the bitumen. In FIG. 6, the 5-95 gap is 150° C.

FIG. 7 is a line graph illustrating the fractionation of an iso-octane based diluent I bitumen blend (Rec=recovered). This figure was obtained by simulating the thermal fractionation of the blend using a standard distillation configuration at atmospheric pressure, comprising a feed preheating train, a feed processing furnace heater, a column with tray, an overhead condenser system, and a stripping steam. The simulation model was developed using commercially available software (UniSim Design R430).

FIG. 8 is a line graph illustrating the results of an iso-octane based diluent/bitumen blend compatibility study. Iso-octane based diluent was blended with bitumen from the Athabasca oil sands in Northern Alberta, Canada at different concentrations and then evaluated for the Solubility Blending Number ($S_{BN}$) and Insolubility Number ($I_N$) using the Oil Compatibility Model by Irwin Wiehe method (see Wiehe & Kennedy, Energy & Fuels, 2000, 14. 56-59) to determine the peptization value or P-Value of the blend. The Oil compatibility Model provides an area of incompatible blends where the $S_{BN}$ of the blend is lower than the crude $I_N$ or a P-Value ($S_{BN}/I_N$) les than or equal to 1. Results of the study are shown, indicating that the incompatibility zone of the Iso-Octane based/bitumen blend was observed above an iso-octane concentration of around 73 vol %.

DETAILED DESCRIPTION OF THE INVENTION

An aspect of the present disclosure involves the separation of a high-octane low vapor pressure diluent from bitumen. In some embodiments, the distinct boiling points of the bitumen and diluent fractions (as discussed with respect to FIG. 6) facilitate a separation that substantially recaptures the diluent with its high octane characteristics, segregated from the bitumen. For example, the initial boiling point (IBP) of the bitumen may be approximately 220° C. to 280° C., the final boiling point (FBP) of an iso octane based diluent is approximately 180° C., and the final boiling point of an alkylate based diluent may be approximately 180° C. to 200° C. In embodiments where it exists, this gap between the FBP of the diluent and the IBP of the bitumen (gap or overlap$_{5/95}$=ASTM D86$_{5\ vol\ \%}$ Temp of HeavyCut—ASTM D86$_{95\ vol\ \%}$ Temp of Light Cut) facilitates the separation of the two fractions, reduces cross contamination between the two fractions and maintains the chemical integrity of the diluent especially with respect to octane number (as discussed with respect to FIG. 7).

In alternative embodiments, the separation of the bitumen and diluent fractions of a blend, for example in refinery fractionation units, my involve capturing at least some of the light ends of the bitumen in the reconstituted diluent. This may for example be the case where the bitumen or heavy oil fraction is particularly rich in more volatile components. In embodiments of this kind, with reduced or non-existent gaps between the FBP of the diluent and the IBP of the bitumen, conditions may be selected for separation and treatment of the reconstituted diluent that preserve an elevated octane number, for example being at least greater than 60 or 66 in alternative embodiments. In alternative embodiments, the separation of the bitumen and the diluent fractions of a blend may involve processes in combination with or other than distillation, for example, membrane separation, The gap between boiling points may be determined empirically, for example using ASTM D86, a basic test method for determining the boiling range of a petroleum product by performing a simple atmospheric batch distillation to determine quantitatively the boiling range (ASTM D86-16a, Standard Test Method for Distillation of Petroleum Products and Liquid Fuels at Atmospheric Pressure, ASTM International, West Conshohocken, Pa., 2016). Distillation and fractionation as utilized in the present disclosure have the usual meanings associated with these terms. Distillation refers to separating a mixture by boiling point into its component parts. Fractionation refers to separation of a mixture into its component parts, for example, by distillation.

In the present disclosure, the term "based", when used to characterize a composition, refers to a mixture of compounds. For example, iso-octane based diluent refers to a diluent including iso-octane and one or more other compounds. For example, the iso-octane based diluent may include more than one $C_8H_{18}$ isomer, or may include one or more iso-octane isomer(s) and other compounds. The other compounds may be, for example, byproducts of the synthesis of iso-octane.

In alternative embodiments, a wide variety of processes may be used to produce high-octane low vapor pressure diluents, for example, but not limited to iso-octane or iso-hexane, for example with starting materials that include butane, isobutane, butene and/or iso-butylene. If butane is the feed, it may for example be transformed into iso-butane through an isomerization process, and the isobutane may be transformed to iso-butylene through a dehydrogenation process, with two moles of iso-butylene combined to make iso-octene, and finally the iso-octene may be hydrogenated to make iso-octane. Dimerization of propane as the feed may be utilized, for example, as a route to making iso-hexane.

Alkylation is a chemical reaction between an iso-paraffin and an olefin to make a paraffin of higher molecular weight. Alkylate can for example be manufactured starting from butane, isobutane, propane, propylene and/or amylene.

In an alternative embodiment, a bitumen blend comprising a high-octane low vapor pressure diluent fraction may be prepared from natural gas condensate, or from any of a wide variety of liquefied petroleum gas (or liquid petroleum gas, LPG) or other feedstocks, for example comprising C3 to C7 hydrocarbons. Such feedstocks may include aromatic compounds. Natural gas condensate may be separated by fractionation, for example into a variety of light fractions and heavy fractions. Heavy fractions separated from the diluent may for example be used for treating emulsions, such as emulsions produced from a reservoir. for example to enhance the separation between bitumen and water.

Light fractions separated from a diluent derived from a natural gas condensate may be characterized, for example, as having an IBP of up to about 80° C., including 95% of the C5-C6 hydrocarbons present in the diluent. Light fractions of this kind may for example be utilized as a feedstock for an isomerization process to convert the linear C5-C6 hydrocarbons into isomers (for example, iso-octane) having a higher octane rating and a lower vapor pressure than the light fraction, and, when blended with bitumen, the isomeric product may reduce diluent requirements for the transportation of bitumen.

In some embodiments, alternative high-octane diluents may be produced via natural gas or solid gasification processes. These alternatives could for example produce a gasoline type diluent with higher octane rating than condensate, but lower than alkylate or isooctane.

The low vapor pressure diluent/bitumen blend may be transported by a variety of methods, including by pipeline, by rail, or by motor vehicle such as a truck or a ship. Depending on market considerations, one form of transportation may be more or less expensive at any given time. Product quality considerations differ between transportation methods. In general, less high-octane low vapor pressure diluent may be blended with bitumen for rail transportation compared to the amount required for pipeline transportation. A diluent-bitumen blend formulated for rail transportation may be referred to as railbit. Dilbit may for example have a diluent:bitumen ratio of about 30:70 to about 40:60. Railbit may for example have a diluent:bitumen ratio of about 12:88 to about 40:60. If the low vapour pressure diluent/bitumen blend is transported by ship across a body of water, the ship may utilize heat to maintain a certain viscosity of the blend during transportation. For the blend to be pumped at a destination (e.g., a marine terminal), the blend viscosity may be, for example, about less than 800 cSt.

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. Numeric ranges are inclusive of the numbers defining the range. The word "comprising" is used herein as an open-ended term, substantially equivalent to the phrase "including, but not limited to", and the word "comprises" has a corresponding meaning. As used herein, the singular forms "a", "an" and "the" include plural referents unless the context clearly dictates otherwise. Thus, for example, reference to "a thing" includes more than one such thing. Citation of references herein is not an admission that such references are prior art to the present invention. Any priority document(s) and all publications, including but not limited to patents and patent applications, cited in this specification are incorporated herein by reference as if each individual publication were specifically and individually indicated to be incorporated by reference herein and as though fully set forth herein. The invention includes all embodiments and variations substantially as hereinbefore described and with reference to the examples and drawings.

EXAMPLES

Iso-Octane Based Diluent

This Example includes data that characterizes the performance of an iso-octane based diluent used as a bitumen diluent. The blend of iso-octane based diluent and bitumen was obtained by mixing between 30% vol and 45% vol of iso-octane based diluent with 55% vol to 70% vol of a sample of bitumen from the Athabasca oil sands in Northern Alberta, Canada, targeting a pipeline viscosity specification of 350 $mm^2/s$ at 11.9° C. FIG. 1 and FIG. 2 illustrate the kinematic viscosity ($mm^2/s$) and density (g/cc) of the iso-octane based diluent over a range of temperatures.

Table 1 shows typical properties of the iso-octane based diluent, including a relatively high octane number (RON 100.5 and MON 99.5).

FIG. 3 and FIG. 4 show the kinematic viscosity and density behaviour, respectively, of the raw Athabasca Bitumen at different temperatures.

FIG. 5 shows the kinematic viscosity of the iso-octane based diluent/bitumen blend at different concentrations (~27-42% vol) of diluent and at different temperatures.

Table 2 shows typical properties of the iso-octane based diluent/bitumen blend with a kinematic viscosity of 351 $mm^2/s$ at 11.9° C.

TABLE 1

Typical properties of iso-octane based diluent

| Analysis | Method | Results | Units |
|---|---|---|---|
| API Gravity at 15° C. | ASTM D4052 | 70.2 | API |
| RON | ASTM D2699 | 100.5 | — |
| MON | ASTM D2700 | 99.5 | — |
| Sulfur Content | ASTM D5453, | 4.4 | mg/kg |
| Reid Vapor Pressure | ASTM5191 | 13.3 | kPa |

TABLE 2

Typical iso-optene based diluent/bitumen blend

| Analysis | Method | Results | Units |
|---|---|---|---|
| API Gravity at 15.6° C. | ASTM D5002 | 26.4 | API (°) |
| Kinematic Viscosity | ASTM 02170 | 351 | $mm^2/s$ |
| Acid Number | ASTM D664 | 1.79 | mg KOH/g |
| Total Sulfur | ASTM D4294 | 3.4 | wt % |
| Micro Carbon Residue | ASTM 04530 | 10.45 | wt % |
| Reid Vapor Pressure | ASTM 323 | <50 | kPa |

FIG. 6 represents the simulated distillation curve for an iso-octane based diluent/bitumen blend obtained in the lab. This figure shows the discontinuity or gap (gap or $overlap_{5/95}$=ASTM $D86_{5\ vol\ \%}$ Temp of HeavyCut—ASTM $D86_{95\ vol\ \%}$ Temp of Light Cut) between the FBP of the diluent and the IBP of the bitumen. This discontinuity in boiling points facilitates the substantially complete separation (~95-98% recovery) of the two fractions and reduces the cross contamination of the two fractions, maintaining the chemical integrity of the diluent, particularly with respect to octane number.

FIG. 7 illustrates the fractionation of an iso-octane based diluent/bitumen blend. This figure was obtained by simulating the thermal fractionation of the blend using a standard distillation configuration: feed preheat train. feed process furnace heater, a column with tray, overhead condenser system, stripping steam, and at atmospheric pressure. The simulation model was developed using commercially available software (UniSim Design R430). This figure shows the comparison (distillation curves) of the original blend materials (iso-octane based diluent and bitumen) with the corresponding materials obtained (recovered) by distillation and shows that the distillation curve for each material prior to blending is similar to the distillation curve for each material after separation from the blend.

In an embodiment of the present disclosure, removal of sulfur-containing compounds (e.g., $H_2S$, mercaptans) from a high-octane low vapor pressure blendstock may be a step in the process of recovering a high-octane low vapor pressure diluent (blendstock) from the high-octane low vapor pressure diluent/bitumen blend. For instance, during at least one of mixing and transporting the high-octane low vapor pressure diluent/bitumen blend, a portion of a sulfur content of the bitumen may transfer to the high-octane low vapor pressure diluent and the transferred portion may then be removed from the diluent after the diluent and bitumen are thermally separated.

FIG. 8 is line graph illustrating the results of an iso-octane based diluent/bitumen blend compatibility study, measuring incompatibility tendency (via P-value) of a iso-octane based diluent/bitumen blend as a function of the concentration (% volume) of iso-octane based diluent, indicating that the incompatibility zone of the iso-octane based diluent/bitumen blend was observed above an iso-octane concentration of around 73 vol % and that the blend is stable/compatible (asphaltenes precipitation is not expected) at a diluent concentration below about 73 vol %. In the context of the present disclosure, stability of a single compound or blend (mixture) of compounds and compatibility of a blend (mixture) of compounds refers to a lack of asphaltenes precipitation, that is, $S_{BN}/I_N>1$, For example, a stable high-octane low-boiling point diluent fraction may be combined with an unstable high-boiling point bitumen fraction to form a compatible low vapor pressure blend.

The invention claimed is:

1. A method of transporting hydrocarbons, comprising:

mixing a high-boiling point bitumen with a miscible high-octane low-boiling point hydrocarbon diluent, to form a low vapor pressure hydrocarbon blend comprising a diluent fraction and a bitumen fraction, wherein the blend has a viscosity of less than about 350 cSt and a density of less than about 940 kg/m$^3$ over a temperature range of from 7.5° C. to 18.5° C., and a Reid vapor pressure (RVP) of less than 65 kPa;

transporting the blend by pipeline; and, separating the diluent fraction from the bitumen fraction, wherein the diluent fraction and the bitumen fraction are thermally separable; wherein, the temperature at which 5% of the bitumen fraction distills (BP-bitumen$_{5\ vol\ \%}$) is higher than the temperature at which 95% of the diluent fraction distills (BP-diluent$_{95\ vol\ \%}$);

the BP-diluent$_{95\ vol\ \%}$ is less than or equal to 220° C.;

the separating comprises heating of the blend and distillation of the diluent fraction;

at least 95% of the diluent is separated from the bitumen in the step of separation; and the initial boiling point of the bitumen fraction is higher than the final boiling point of the diluent fraction.

2. The method of claim 1, wherein:

the diluent separated from the bitumen is a high-octane gasoline blendstock;

the diluent separated from the bitumen has an (R+M)/2 octane rating of at least 80;

the blend has a RVP of less than 60 kPa;

the diluent comprises at least 25% iso-octane or iso-hexane by volume;

the blend comprises less than 1% by weight olefins.

3. A method of making a high-octane gasoline blendstock, comprising:

providing a high-octane low-boiling point hydrocarbon diluent;

mixing the diluent with a high-boiling point bitumen, wherein the diluent is miscible and compatible with the bitumen to form a low vapor pressure hydrocarbon blend comprising a diluent fraction and a bitumen fraction, wherein the blend has a viscosity of less than 350 cSt and a density of less than 940 kg/m$^3$ over a temperature range of from 7.5° C. to 18.5° C., and a Reid vapor pressure (RVP) of less than 65 kPa;

transporting the blend by pipeline; and separating the diluent fraction from the bitumen fraction, wherein, the temperature at which 5% of the bitumen fraction distills (BP-bitumen$_{5\ vol\ \%}$) is higher than the temperature at which 95% of the diluent fraction distills (BP-diluent$_{95\ vol\ \%}$);

the BP-diluent$_{95\ vol\ \%}$ is less than or equal to 220° C.;

the separating comprises heating of the blend and distillation of the diluent fraction;

at least 95% of the diluent is separated from the bitumen; and the initial boiling point of the bitumen fraction is higher than the final boiling point of the diluent fraction.

4. The method of claim 3, wherein:

the blend has a RVP of less than 60 kPa;

the diluent comprises at least 25% iso-octane or iso-hexane by volume; and the blend comprises less than 1% by weight olefins.

5. The method of claim 3, further comprising removing sulfur-containing compounds from the separated diluent fraction.

6. The method of claim 4, further comprising removing sulfur-containing compounds from the separated diluent fraction.

7. The method of claim 2, wherein:

the diluent comprises greater than 85% by volume branched-chain alkanes;

the bitumen has a viscosity of at least 700,000 cSt at 15° C.;

the bitumen has a density of less than or equal to 1,000 kg/m$^3$ at 15° C.; and the volume fraction of bitumen in the blend is higher than 60%.

8. The method of claim 4, wherein:

the diluent comprises greater than 85% by volume branched-chain alkanes;

the bitumen has a viscosity of at least 700,000 cSt at 15° C.;

the bitumen has a density of less than or equal to 1,000 kg/m$^3$ at 15° C.; and the volume fraction of bitumen in the blend is higher than 60%.

* * * * *